US005167559A

United States Patent [19]

Power-Fardy

[11] Patent Number: 5,167,559

[45] Date of Patent: Dec. 1, 1992

[54] MECHANIZED BRIM/VISOR DISPLAY DEVICE

[76] Inventor: Stephen N. Power-Fardy, 4233 W. 172nd St., Torrance, Calif. 90504

[21] Appl. No.: 699,672

[22] Filed: May 14, 1991

[51] Int. Cl.[5] ..... A63H 33/00; A42C 5/00; A42B 1/02

[52] U.S. Cl. ..... 446/27; 2/186; 2/199

[58] Field of Search ..... 446/26, 27, 28, 3, 322, 446/396; 2/185, 186, 199; 84/484

[56] References Cited

U.S. PATENT DOCUMENTS

| | | | |
|---|---|---|---|
| 65,542 | 6/1867 | Carden | 84/484 |
| 951,946 | 3/1910 | Force | 2/186 |
| 1,618,517 | 2/1927 | Cureton | 446/27 |
| 2,960,793 | 11/1960 | Van Cleave | 446/27 |
| 4,422,261 | 6/1982 | Kozuka et al. | 46/104 |
| 4,488,372 | 12/1984 | Lowen | 446/27 |
| 4,586,280 | 5/1986 | Dane | 446/27 X |
| 4,658,446 | 4/1987 | McGill | 446/26 X |
| 4,729,747 | 3/1988 | Yeh | 446/27 |
| 4,776,043 | 10/1988 | Coleman | 2/185 R X |
| 4,777,667 | 10/1988 | Patterson et al. | 446/27 X |
| 4,832,647 | 5/1989 | Perlman | 446/27 |
| 4,836,820 | 4/1988 | Ebihara et al. | 446/289 |

FOREIGN PATENT DOCUMENTS

| | | | |
|---|---|---|---|
| 2322046 | 4/1977 | France | 446/27 |

OTHER PUBLICATIONS

"Slinky Satellite Beanie," Playthings, Jun. 1958, p. 18.
Magic Visor (R) patent pending N. 75210371 The Johnson Smith Company Catalog pp. 24, 26, 53, 56.
The Sharper Image Catalog p. 6.
The Quartermaster Catalog p. 78.

*Primary Examiner*—Robert A. Hafer
*Assistant Examiner*—D. Neal Muir

[57] ABSTRACT

In combination with a baseball-type cap, this device provides the wearer with a way to express a specific sentiment when the reciprocating attention-attracting symbol is put into motion by a wind up motor. The device consists of a reciprocating arm to which a symbol or message that depicts the wearer's sentiments is attached. To achieve the desired effect, the wearer winds up the motor and the reciprocating arm pivots at the base of the arm in the housing producing a back-and-forth motion of the attention-attracting symbol.

5 Claims, 2 Drawing Sheets

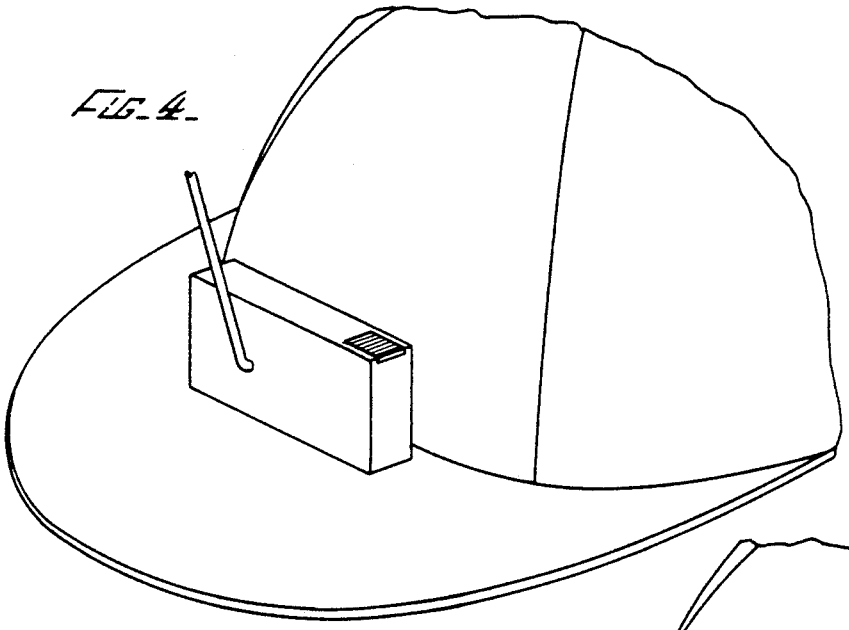
FIG. 4.
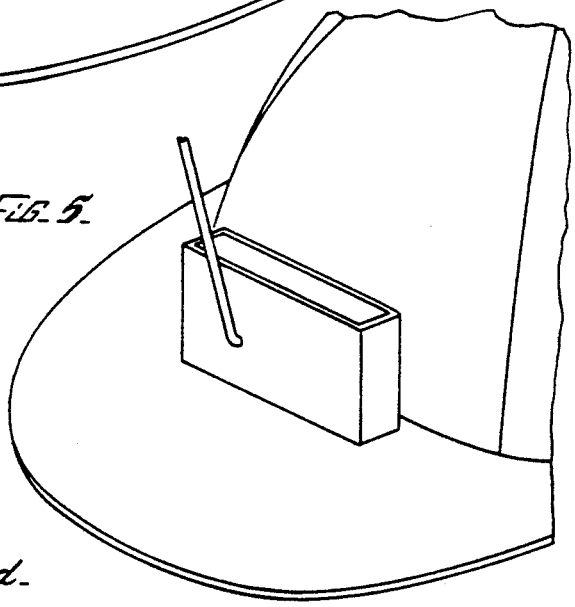
FIG. 5.
FIG. 3a.
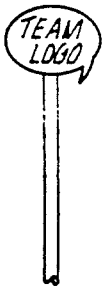
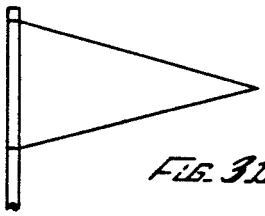
FIG. 3b.
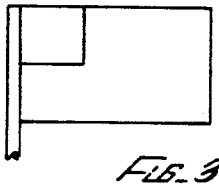
FIG. 3c.
FIG. 3d.
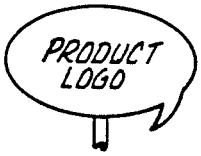
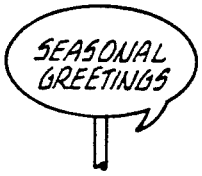
FIG. 3e.
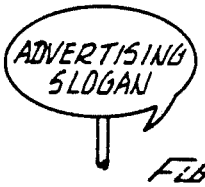
FIG. 3f.
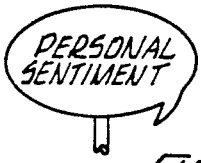
FIG. 3g.

MECHANIZED BRIM/VISOR DISPLAY DEVICE

BACKGROUND

1. Field of Invention

This invention relates to headpieces with a visor or similar projection from the brim, used for shading the eyes from the sun.

In particular, this invention pertains to the mechanized display of team logos, pennants, symbols, flags, product logos, seasonal greetings, advertising slogans, messages and the like, on the brim/visor of head apparel.

2. Description of Prior Art

With the advent of the baseball cap, sports teams, advertisers and cap manufacturers have sewn, stitched, ironed-on, and through various other means, affixed the logo of their teams, company or message to the forehead covering portion of the cap.

Some have even made the visor of a translucent plastic and painted their logos or messages directly onto the visor.

The U.S. Military uses the visor to display rank. In the army the visor on caps is used to display the stars of generals. And in the navy and NASA, the visor is used to display the "scrambled eggs" epaulets of officers. (See page 78 of "Quartermaster" [750 Long Beach Blvd. Long Beach, Calif. 908713] catalog for a picture of "scrambled eggs" on a typical cap).

No company, country, inventor, or organization, however, has taken advantage of the platform-like message displaying potential that a mechanized device could exploit if attached onto the celestial side of the visor on an existing piece of head wear.

The applicant performed an exhaustive search to find any applicable prior art examples in the abstracts listed in the OFFICIAL GAZETTE but could not find any prior art example that described a mechanized device of any description that attached to the visor of a headpiece.

The areas searched by the applicant included:

| | Class | Subclass |
|---|---|---|
| Amusement and Exercising Devices | 272 | |
| Amusement Devices, Toys | 446 | * |
| Amusement Devices, Games | 273 | 1 |
| Apparel Apparatus | 223 | 2 |
| Merchandising | 186 | |
| Motors, Spring, Weight and Animal Powered | 185 | 4 |
| Oscillators | 331 | |
| Spring Devices | 267 | 5 |
| * Design | D21 | 59+ |
| Spinning and Whirling | 446 | 236+ |
| Figure Toys | 446 | 268+ |
| 1 Design | D21 | 240+ |
| 2 Adornment, Attachable | D11 | |
| 4 Spring | 185 | 37+ |
| 5 Toy Vehicle | 446 | 464 |

U.S. Pat. No. 4,836,820 to Satoru Ebihara, and Jiro Yamaguchi illustrates a moving animal toy whose wind-up operating mechanism is the closest application of a wind up system the applicant could find to the invention presented for the examiner's review in this patent application. But since this animal toy teaches a way to execute a walking motion and not a stationary pivoting motion of a reciprocator in a visor mounted device, the invention described herein for the examiner's consideration which comprises a similar wind-up device shows new and surprising results.

Likewise, U.S. Pat. No. 4,422,261 to Michihiro Kozuka, and Masayuki Tonokura teaches a method of accomplishing pivotal movement of a toy on a support surface with a similar wind-up mechanism. Though the system to provide the energy for the movement may be similar to the system of the Mechanized Brim/Visor Display Device explained here, the results are dramatically different.

The applicant's search for prior art was not limited to the OFFICIAL GAZETTE publication of the U.S. Department of Commerce Patent and Trademark Office. Novelty catalogs of every description were also painstakingly researched.

Although many hat inventions ranging from hats with radios, hats with drinking straws, hats with clapping hands, hats with clocks, hats with sunglasses attached to the brim, to hats with solar powered fans, none were remotely similar to a mechanized visor/brim display device that could be attached to an existing cap in an aftermarket type application.

Magic Visor (R) patent pending N. 75210371 distributed by Davidcraft Corporation, Ill. 60645 illustrates a battery powered visor that features a fan, a flashlight and an air freshener. The differences between this visor and the mechanized visor/brim display device are enormous. In addition to the fact that the Magic Visor does not have a reciprocator, or any other display capability, the Magic Visor is a one piece fan, flashlight, visor unit. Whereas the mechanized visor/brim display device does have enormous display capability and is a separate device which can be connected to any existing visor or brim.

The Johnson Smith Company (4514 9th Court East, P.0. Box 255500, Bradenton, Fla. 34206-5500) catalog offers for sale many interesting hat inventions and novelties in its current "Things You Never Knew Existed (TM) . . . and others you can't possibly live without!" catalog.

On page 24 of the company's catalog issue #912, the company offers for sale a Deluxe AM/FM cap. According to the sales copy it's a lightweight cap with a concealed built-in radio. Earphones are incorporated into the design and wires are hidden from view. A big selling feature of this cap is its hands-free operation.

Though it may be a novel idea putting a radio in a hat it is hardly as ingenious as the mechanized visor/brim display device. Radios are commonplace in our society, but a device mounted on a visor that expresses the sentiments of the wearer is unique.

On page 26 of the same catalog a hat is then combined with an even more commonplace article—a clock. Though perhaps a humorous idea, it does not demonstrate a bold new concept in hats and their devices as the mechanized visor/brim display device.

On page 53 of said catalog, a cap sports a pair of sunglasses from its visor. The applicant examined said cap and its tag revealed UVEXFLIP is a trademark of UVEX Winter Optical Inc., and that U.S. and foreign patents on this cap were pending.

Though the idea of utilizing the visor for more than a shading device is similar in idea to the mechanized visor/brim display device, that's where the comparison ends. The sunglasses and cap all in one invention puts together two items already in separate use into a combination. The mechanized visor/brim display device is a heretofore original device that uses the visor as the optimum display location.

On page 56 of said catalog, four other hat inventions are illustrated. Again, the drinking helmet, clapping cap, the solar powered Satari hat with built-in air-conditioning, and the pocket umbrella hat are all specialized single-unit hats. The mechanized visor/brim display device is an add-on device to an existing hat.

And what's more, the hats illustrated on said page 56 while they have tremendous notoriety, have nothing to do with a mechanized display device, visor/brim mounted or otherwise.

On page 6, in "The Sharper Image" (650 Davis Street, San Francisco, Calif. 94111) catalog (March 1991), they show a baseball cap with a solar powered fan. And while they are making the most of the visor for shading and cooling the wearer, they are not using the cap's display potential at all.

SUMMARY OF THE INVENTION

Accordingly, the reader can see that the mechanized visor/brim display device can provide the wearer with a unique opportunity to express their sentiments. When the wearer wishes his/her sentiments be put in motion, they simply activate the device and the reciprocator arm with their team logo, pennant, symbol, flag, product logo, seasonal greeting, advertising slogan, message or the the like, attached, reciprocates until the energy of the spring wind up device, battery or other source is expended or terminated.

Although the description above contains many specificities, these should not be construed as limiting the scope of the invention but merely providing illustrations of some of the presently preferred embodiments of this invention.

For example, the invention may have several reciprocal arms; the reciprocal arm may actually rotate instead of reciprocate; the motion providing means may be a battery, a spring wound device, or a solar powered unit; the mechanized display device might not be attached to the visor, but instead incorporated into the visor.

Thus the scope of the invention should be determined by the appended claims and their legal equivalence, rather than by the descriptions, examples, objects and advantages given.

BRIEF DESCRIPTION OF THE DRAWINGS

FIG. 3*a* is a front view of a display device comprising a team logo.

FIG. 3*b* is a front view of a display device comprising a pennant.

FIG. 3*c* is a front view of a display device comprising a flag.

FIG. 3*d* is a front view of a display device comprising a product logo.

FIG. 3*e* is a front view of a display device comprising a seasonal greeting.

FIG. 3*f* is a front view of a display device comprising a advertising slogan.

FIG. 3*g* is a front view of a display device comprising a message.

FIG. 4 is a front raised lateral view of a battery powered motion providing means including an on-off switch.

FIG. 5 is a front raised lateral view of a solar powered motion providing means, including a solar panel and an on-off switch.

Reference Numerals in Drawings

Figure 1:
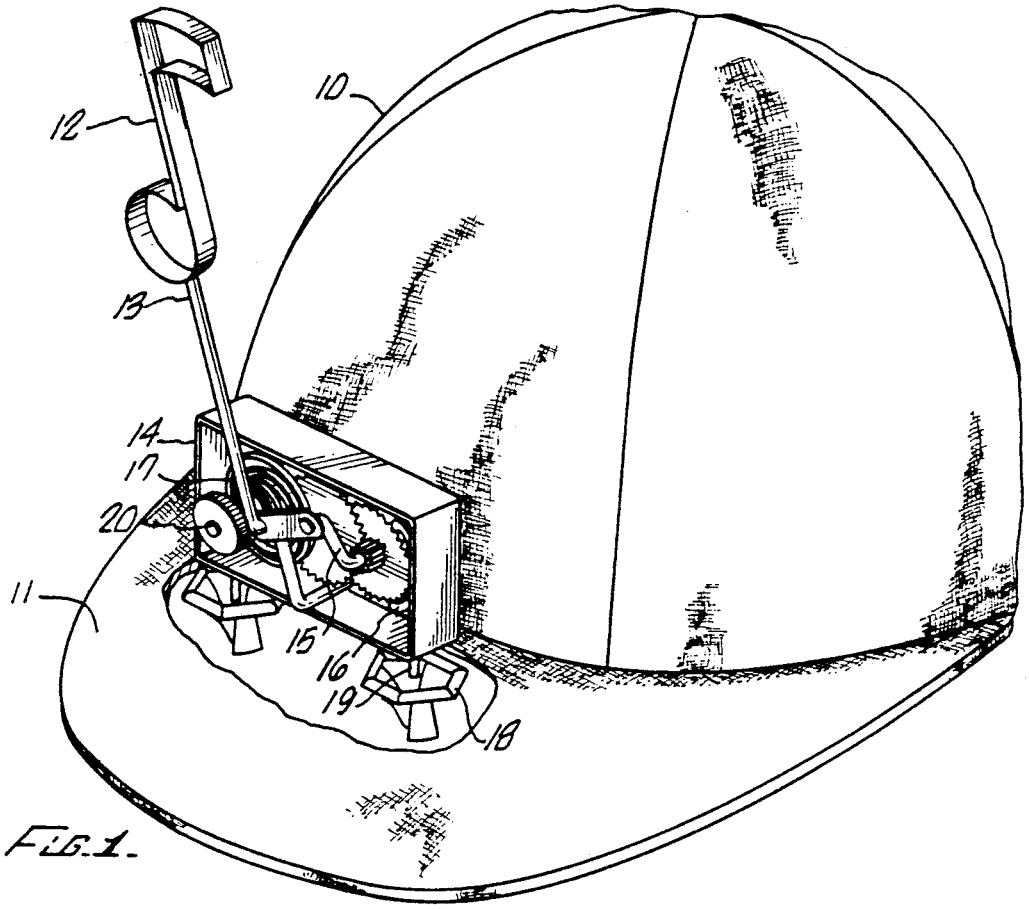
FIG. 1 shows the internal winding mechanism of the invention, and the invention held in position on the visor by two spike shaped members which protrude from the bottom of the housing, pierce through the brim and are affixed to the visor by a fastener technique.
Figure 2:
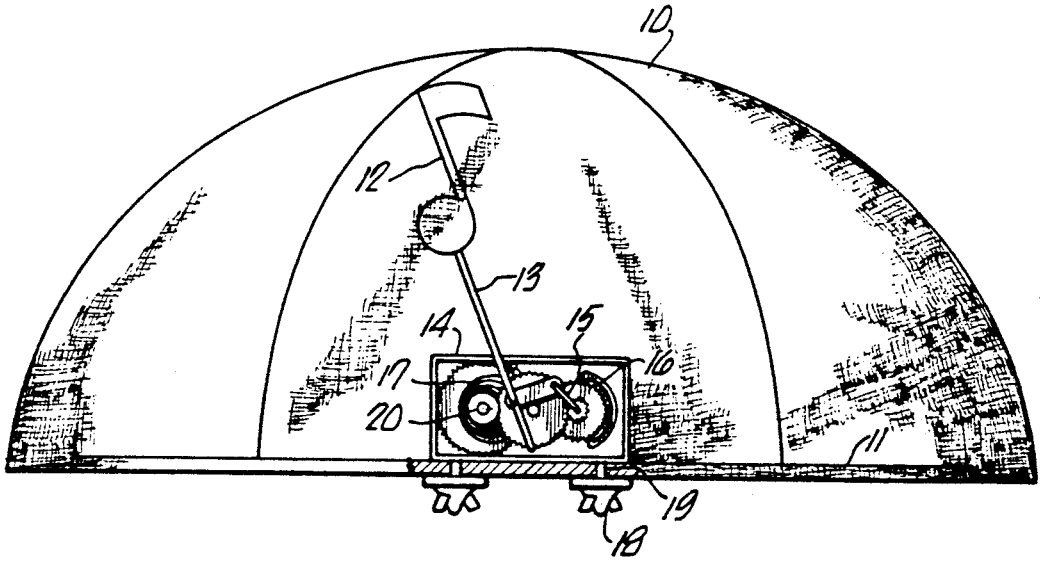
FIG. 2 shows the invention in position on the visor/-brim of a cap as it would be seen from a vantage point directly in front of the wearer.

| | |
|---|---|
| 10 Cap | 11 Visor |
| 12 Logo/Symbol/Message | 13 Reciprocator Arm |
| 14 Housing | 15 Offset Driveshaft |
| 16 Escapement | 17 Flat Spring |
| 18 Fasteners | 19 Spike Shaped Members |
| 20 Wind-Up Knob | |

PREFERRED EMBODIMENT OF THE INVENTION

The preferred embodiment of the invention comprises of a conventional spring-wound motor with an off-set drive gear 15 enclosed in a housing 14. At the base of the housing is a point at which a vertically-inclined reciprocating arm 13 is allowed to pivot, while being held in place by the off-set-drive gear configuration.

When the motor is activated the offset drive gear 15 rotates providing motion to the reciprocating arm 13, which in turn pivots at the base of the housing 14 allowing the non-pivoting end of the arm to reciprocate through the perpendicular above the pivot point in an acute to obtuse angle arc.

At the top of the non-pivoting end of the reciprocating arm 13 is an attention-attracting symbol 12. Symbol 12 may be chosen to match the sentiments of the wearer to suit any sporting event or social occasion.

The device is held in position on the bill of a baseball-type cap by two fasteners 18 which grasp onto the two spike shaped members 19 protruding from the housing and through the cap.

While the foregoing invention has been described with reference to its preferred embodiments, it should not be limited to such embodiments since various alterations and modifications will occur to those skilled in the art. All such modifications and variations are intended to fall within the scope of the claims.

I claim:

1. A device featuring a visor, further comprising:

a) a spring motor enclosed in a housing with a base;

b) a reciprocating arm with a base geared to said motor and held in place at the base of said housing, permitting said arm to pivot, thus allowing an opposite end of the arm to reciprocate through the perpendicular of the pivot and above the housing in an acute to obtuse angle arc;

c) an attention-attracting symbol attached to a non-pivoting end of said reciprocating arm;

d) an attaching means to hold said device in position on the visor of said cap, said attaching means comprising a fastener; and e) a wind-up shaft attached to the motor, protruding from the housing, enabling activation of the spring motor to provide a reciprocating motion to the reciprocating arm and said attached attention-attracting symbol.

2. The device as set forth in claim 1 wherein said attention-attracting symbol is depicting one of:

a. a specific team logo;

b. a pennant;

c. a flag;

d. a product logo;

e. a seasonal greeting;

f. an advertising slogan; or g. a personal sentiment.

3. The device as set forth in claim 1 further comprising a plurality of reciprocating arms, and a plurality of attention-attracting symbols.

4. A baseball cap visor-mounted device comprising;

a) an electric motor enclosed in a housing;

b) a switch and a circuit, enabling activation of said electric motor;

c) a reciprocating arm with a base geared to said motor and held in place by a pivot pin internally located at the base of said arm and said housing, allowing the opposite end of the arm to reciprocate through a central perpendicular point located above the housing in an acute to obtuse angle arc;

d) an attention-attracting symbol attached to the non-pivoting end of said reciprocating arm; and e) an adhering means between the housing and the visor comprising a fastener to hold the device in place on the visor of said cap.

5. The device as set forth in claim 4 wherein said electric motor means is solar-powered.

* * * * *